US006471153B1

(12) United States Patent
Kimura et al.

(10) Patent No.: US 6,471,153 B1
(45) Date of Patent: Oct. 29, 2002

(54) VIBRATION CONTROL APPARATUS FOR STEEL PROCESSING LINE

(75) Inventors: Tetsuyuki Kimura, Ise (JP); Yasushi Muragishi, Ise (JP); Kazumichi Kato, Ise (JP)

(73) Assignee: Shinko Electric Co., Ltd., Tokyo (JP)

( * ) Notice: Subject to any disclaimer, the term of this patent is extended or adjusted under 35 U.S.C. 154(b) by 0 days.

(21) Appl. No.: 09/577,184

(22) Filed: May 23, 2000

(30) Foreign Application Priority Data

May 26, 1999 (JP) ..... 11-147297
May 26, 1999 (JP) ..... 11-147298
Aug. 27, 1999 (JP) ..... 11-242342

(51) Int. Cl.[7] ..... B65H 20/00; B65H 77/00
(52) U.S. Cl. ..... 242/419.3; 226/15; 226/93
(58) Field of Search ..... 242/615, 907, 242/419.3; 226/15, 24, 93; 700/114, 213

(56) References Cited

U.S. PATENT DOCUMENTS 3,661,116 A * 5/1972 Moskowitz et al. ..... 118/6
4,655,166 A * 4/1987 Nishimura et al. ..... 118/673
5,074,242 A * 12/1991 Briemont ..... 118/665
6,095,449 A * 8/2000 Gallo et al. ..... 242/365.4

FOREIGN PATENT DOCUMENTS

JP 02062355 A * 3/1990
JP 05245522 A * 9/1993
JP 05245523 A * 9/1993
JP 07256325 A * 10/1995
JP 8120433 A * 5/1996
JP 8247211 * 9/1996
JP 10298727 A * 11/1998
JP 02000053293 A * 2/2000
JP 02000053295 A * 2/2000
WO WO-9711016 * 3/1997

OTHER PUBLICATIONS

Palm, William, "Control Systems Engineering", Published by Joh Wiley and Sons, 1986, p. 334–351.*

* cited by examiner

*Primary Examiner*—Donald P. Walsh
*Assistant Examiner*—Joseph C Rodriguez
(74) *Attorney, Agent, or Firm*—Darby & Darby

(57) ABSTRACT

The present invention relates to an apparatus for controlling vibration of steel sheet being processed in a processing line. The apparatus includes: electromagnet devices for generating magnetic forces acting at right angles on the steel sheet; sensor devices for detecting separation distances between the steel sheet and the electromagnet devices; control devices for controlling a flow of excitation current through the electromagnet devices according to separation distances detected by the sensor devices; and actuator devices for adjusting the separation distance between the steel sheet and the electromagnet devices; wherein the actuator devices adjust the separation distance when a specific condition is attained in a positional relationship between the steel sheet and the electromagnet devices.

9 Claims, 18 Drawing Sheets

| SHEET THICKNESS | $T_1$ | $T_2$ | $T_3$ | $T_4$ | $T_5$ |
|---|---|---|---|---|---|
| PID GAIN | $G_1$ | $G_2$ | $G_3$ | $G_4$ | $G_5$ |

VIBRATION CONTROL APPARATUS FOR STEEL PROCESSING LINE

BACKGROUND OF THE INVENTION

1. Field of the Invention

The present invention relates to an apparatus for controlling the vibration of a steel sheet being driven along the running surface of a processing facility in a steel rolling line or surface treating line in a steel mill.

2. Description of the Related Art

FIG. 27 shows a schematic diagram of a conventional apparatus for controlling the vibration of a steel sheet 101 being processed, by placing opposing electromagnets 102A, 102B on the front and back sides across the steel sheet 101.

In such an apparatus, sensors 107A, 107B are placed inside the electromagnets 102A, 102B, respectively, for detecting the distances from the steel sheet 101 to respective electromagnets 102A, 102B, and the excitation currents passing through the coils in the electromagnets 102A, 102B are controlled according to the distances detected by the sensors 107A, 107B, so that the magnetic attraction forces can be adjusted in such a way to reduce the vibrations.

This vibration control apparatus comprises a plurality of pairs of electromagnets 102~105 arranged transversely to the running direction of the steel sheet, as seen in a plan view of the steel sheet 101 shown in FIG. 28. Pairs of sensors 107~110 are placed in paired electromagnets 102~105 so that the magnitudes of the excitation current can be adjusted according to respective separation distances detected by the paired sensors.

In such a vibration control apparatus, because of bowing in the steel being rolled, the path of the steel sheet can sometimes show a tendency to be closer to one or the other electromagnet depending on the type of steel being processed and the running speed. If the control of electromagnets is started under such a condition, the control apparatus, in its effort to correct bowing of the steel sheet, tries to deliver more current to the electromagnet that is farther away from the sheet. However, a considerable force is required when the steel sheet is thick so that it is necessary to supply a high current to develop the necessary magnitude of force. Under such a circumstance, excitation current may become saturated due to factors such as inadequate capacity of the amplifier for the electromagnet, which may result in virtual loss of vibration control.

Also, when starting or stopping the vibration control action of the apparatus, if the apparatus is simply turned on or off, the excitation current changes suddenly to cause the steel sheet to hunt for a balancing position thus resulting in wild oscillation, and in extreme cases, the surface of the steel may collide with the surface of the magnetic poles to cause scratches on the steel sheet.

Also, when starting the control action, if the steel sheet is vibrating with such a large amplitude that the electromagnets cannot be brought into a proper range for control action, it may be considered that the electromagnets may be brought into proper positions after starting the process line. However, if the gap is large and the steel sheet is outside the range of detection of the sensors and the sensors are not able to detect the sheet position properly, there is a possibility that the steel sheet can be induced into oscillation.

Also, in the control apparatus described above, the relationship between the electromagnet pairs and the running sheet is subject to continual change because of such factors as the variations in the sheet thickness and width of the steel roll to be processed. For this reason, if the gain of the control apparatus is fixed at a constant value, changes in thickness, for example, may make the steel sheet susceptible to vibration to such an extent that the sheet surface may touch the pole surfaces of the electromagnets, in some cases.

Also, widthwise snaking of the steel sheet may occur in such a way that the edge of the steel sheet 101 swings to the position shown by the dotted line in FIG. 28. In such a case, the steel sheet 101 positions itself in an ambiguous-location between the pair of electromagnets 102 so that, in spite of the fact that the sensor pair 107 inside the electromagnet pair 102 cannot detect the distances to the steel sheet, the control action in this case would be based on the detected distance of the sensor pair 107 to the steel sheet, therefore, control action on the electromagnet pair 102 becomes impossible. Under such a circumstance, the steel sheet may undergo vibration or the surface of the sheet 101 may touch the pole surfaces of the electromagnet pair 102 to cause scratches on the sheet 101.

Also, if the steel sheet moves completely out of the detection range of the pair of electromagnet placed near the edge of the steel sheet, power will be wasted by the pair of electromagnets that are out of the range of detecting the steel sheet.

All of the foregoing problems may also be caused by changes in the width of the steel sheet being processed, for example.

Also, this type of control apparatus is normally operated so that the steel sheet would pass through the center line between the pair of opposing electromagnets. But, when the type of steel being processed changes in a given roll, that is, when a welded joint is passing through, the electromagnets are sometimes moved away from their normal detection position to a standby position to avoid collision of the welded section with the electromagnets. If the move is made while the electromagnets are turned on, even though the position of the steel line has not changed, the relative distances between the steel sheet and the electromagnets would increase, so that the control apparatus judges that the steel sheet has moved in a direction away from the sensors, and increases the excitation current to the electromagnets.

In this case, because the electromagnets are moving away from the steel sheet, the current increases as the electromagnets are moved away, and ultimately the control apparatus capability reaches its saturation limit, and the apparatus becomes inoperable. In the worst case scenario, the magnets may be overheated and destroyed.

To avoid such phenomena from happening, power to the conventional apparatus is turned off when the electromagnets are to be moved to the standby position. In the absence of vibration control action, vibration can be introduced in the processing line, and particularly during the initial stage of preparing for the standby operation, in other words, while the distance of separation between the electromagnets and the steel sheet is small, there is a danger that the steel sheet may contact the electromagnets.

SUMMARY OF THE INVENTION

It is an object of the present invention to provide an apparatus for controlling vibration of a steel sheet being processed in a steel processing line, so that the processing line can be operated in a stable manner without having operational problems such as sheet vibration or loss of vibration control caused by such factors as snaking of the steel sheet or changes in the conditions of the sheet such as varying sheet thickness and width in the running sheet.

Also, it is another object of the present invention to provide a vibration control apparatus that permits the electromagnets to be retreated to a standby position without causing a line instability or excessive heating and damage to the electromagnets.

The object has been achieved in an apparatus for controlling vibration comprised by: electromagnet means for generating magnetic forces acting at right angles on the steel sheet; sensor means for detecting separation distances between the steel sheet and the electromagnet means; control means for controlling a flow of excitation current through the electromagnet means according to separation distances detected by the sensor means; and actuator means for adjusting the separation distance between the steel sheet and the electromagnet means; wherein the separation distance is adjusted by the actuator means when a specific condition is attained in a positional relationship between the steel sheet and the electromagnet means.

The present apparatus for controlling vibration may also be comprised by: electromagnet means for generating magnetic forces acting at right angles on the steel sheet; sensor means for detecting separation distances between the steel sheet and the electromagnet means; control means for controlling a flow of driving current through the electromagnet means according to separation distances detected by the sensor means; wherein a circuit gain for controlling the driving current is determined in accordance with information on the steel sheet, including thickness data, running speeds, joint locations, sheet widths and line tension data.

The present apparatus for controlling vibration may also be comprised by: electromagnet means for generating magnetic forces acting at right angles on the steel sheet; sensor means for detecting separation distances between the steel sheet and the electromagnet means; control means for controlling a flow of driving current through the electromagnet means according to a specific command value and separation distances detected by the sensor means; and moving means for moving the electromagnet means transversely to move away from the steel sheet so as to retreat to a standby position or to return to a detection position; wherein the moving means moves the electromagnet means to move away from the steel sheet to the standby position, according to sheet information including welded joint data, and to further perform a return operation to return to the detection position, and the control means alters the position command value when moving the moving means according to a distance to be moved, and further provides a return operation command.

The present apparatus for controlling vibration may also be comprised by: electromagnet means comprised by opposing pairs of electromagnets disposed in proximity of front and back surfaces of the steel sheet for generating magnetic forces acting at right angles to sheet surfaces; sensor means disposed so as to form opposing pairs of sensors for detecting respective separation distances between the steel sheet and the opposing pairs of electromagnets; control means for controlling a flow of driving current through the pairs of electromagnets according to differences in separation distances generated by the opposing pairs of sensors and specific position command values derived from the differences in separation distances; and moving means for moving-the electromagnet means transversely to the steel sheet so as to retreat to a standby position or to return to a detection position; wherein the moving means move the pairs of electromagnets to move away from the steel sheet to the standby position, according to sheet information including joint location data.

Any of the apparatuses described above is able to operate a processing line in a stable manner because an electromagnet requiring a higher flow of steady-state current than others in the sensor array is pushed closer to the sheet, in so doing, the supply of current to the electromagnet, which is most remote from the steel sheet, is reduced thereby reducing the load on the electromagnet and restoring the steady-state operation of the processing line.

The apparatus may be operated according to a condition that when the separation distance between an electromagnet and the sheet exceeds a specific value, an actuator device brings the electromagnet closer to a sheet steel to reduce the steady-state current flowing in the electromagnet to reduce its load to provide a stable vibration control.

The apparatus may be operated so that an electromagnet is moved by actuator means in a direction to nullify the low frequency components or direct current components, thereby reducing the load on the electromagnet and providing a stable operation of the processing line.

The apparatus may be operated so that a separation distance between a steel sheet and electromagnets is adjusted by paired electromagnets opposing each other across a steel sheet without altering the relative positions of the paired electromagnets, thereby reducing the load on the electromagnets and operating the line in a stable manner.

The apparatus may be operated so that, when starting or ending to control the excitation current, the apparatus adjusts the controlling gain and steady-state current in electromagnet means according to a ramp function, thereby preventing the generation of a phenomenon of "hunting", i.e., oscillation of the strip of steel being processed.

The apparatus may be operated so that, when starting or ending to control a flow of excitation current to an electromagnet, the deviation in the steady-state location of an electromagnet in the integration means are reset to a zero, thereby reducing rapid changes in the excitation current and preventing "hunting".

The entire operation of the vibration control apparatus is made smoother by using the present apparatus, because it is possible to bring the electromagnet closer to the steel sheet while soft-starting the vibration control system, or retreating the electromagnet away from the steel sheet by soft-stopping the vibration control means.

The present apparatus is controlled so that the controlling gain is determined according to detected distances of individual sensors, so that it is possible to prevent collision between the steel sheet and the pole surface of the electromagnet due to vibration caused by changes in the sheet condition such as sheet thickness and other parameters of the steel sheet being processed.

Also, internal judging means are provided in the apparatus so that when it is decided that a steel sheet is not present within a given range of a sensor, the controlling gain for this sensor is reduced to zero. For example, when the steel sheet is out of the range of detection of the sensor due to snaking or changes in the sheet width, the apparatus turns off the electromagnet corresponding to this sensor, thereby preventing waste of electrical energy.

Also, when snaking in the widthwise direction of the running sheet causes an uncertainty in detecting the edge of the steel sheet between a pair of electromagnets, the apparatus does not cause the paired electromagnets to become inoperative, thereby preventing loss of control of vibration or damage to the surface by collision of the sheet against the electromagnet.

The present apparatus is provided with a gain table based on information on a variety of steel sheets, including thickness data, running speeds, joint locations, sheet widths and line tension data, so that a controlling gain for each type of steel sheet is determined according to the gain table, thereby preventing vibration and resulting collision between the sheet and the pole surface of the electromagnet.

Also, even if the type of steel sheet varies within a given roll, stable operation can be continued by switching the electromagnets to be operated and suitably adjusting the controlling gain.

Also, if a weld joint is detected indicating a change in the type of steel to be processed, the controlling gain can be altered automatically so that manual alteration by a line operator is not required.

Also, in the present apparatus, the electromagnet means are disposed in such a way that electromagnets disposed on a front-side do not oppose electromagnets disposed on a back-side of a steel sheet, thereby preventing erroneous detection caused by mutual interference between the opposing electromagnets.

Also, the present apparatus is able to retreat the electromagnets to a standby position, or return the electromagnets to the detection position while performing vibration control by varying the position command value in accordance with a separation distance detected by a relevant pair of electromagnets, so that a flow of excessively high excitation current or overheating and damage to the electromagnets can be prevented.

Also, by detecting the separation distance using a pair of electromagnets across the steel sheet, obtaining a difference in the separation distance, and controlling the excitation current in accordance with the difference, the opposing pair of electromagnets can be retreated at the same time without altering the position command value, to prevent a flow of excessively high excitation current or overheating and damage to the electromagnets.

Also, the apparatus includes integration means which can be inactivated when the electromagnets are to be retreated so that even when the separation distance exceeds the sensor detection range, a flow of excessively high excitation current or overheating and damage to the electromagnets can be prevented.

DESCRIPTION OF THE PREFERRED EMBODIMENTS

The embodiments shown in the following are provided for illustrative purposes only and are not meant to restrict the present invention in any way. Also, to achieve the object of the present invention, it is not always necessary to provide combinations of all the features presented in the examples.

Embodiment 1

Figure 1:
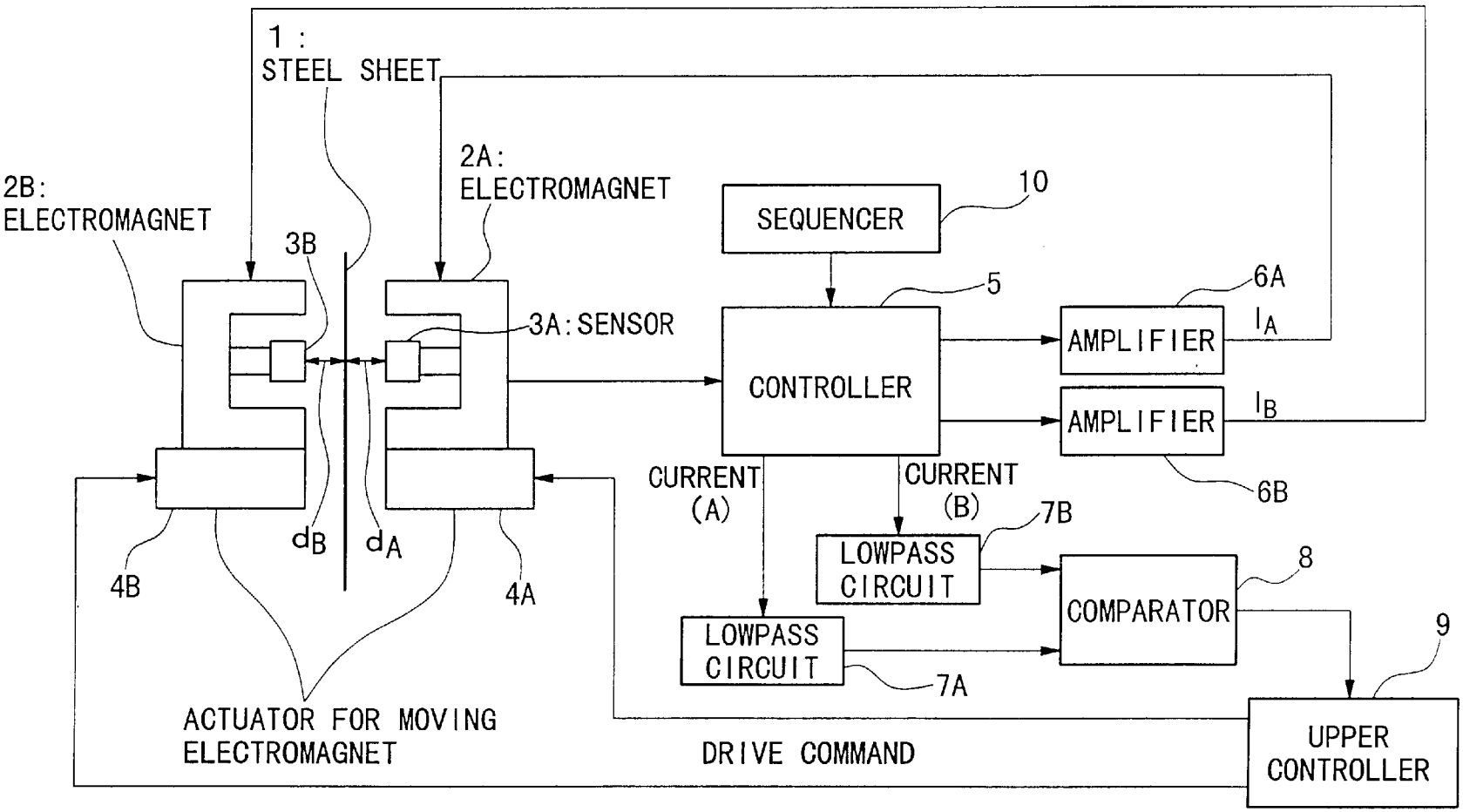
FIG. 1 is aschematic block diagram of a vibration control apparatus in Embodiment 1.

Preferred embodiments will be explained with reference to the drawings. FIG. 1 shows a block diagram of the vibration control apparatus in Embodiment 1. The steel sheet 1 shown in its side view is moving from the bottom to the top of the diagram. An electromagnet 2A faces the front surface of the steel sheet 1 and an electromagnet 2B faces the back surface of the steel sheet 1, and are placed opposite to each other with the steel sheet 1 intervening therebetween. A sensor 3A is provided inside the electromagnet 2A to detect the distance to the steel sheet 1 and a similar sensor 3B is provided inside the electromagnet 2B. The detection plane of sensor 3A is coplanar with the pole surface of the electromagnet 2A, and similarly the detection plane of sensor 3B is coplanar with the pole surface of the electromagnet 2B. Sensors 3A, 3B are also opposite to each other with the steel sheet 1 intervening therebetween. Electromagnet 2A is installed on an electromagnetic (e/m) actuator 4A and electromagnet 2A is installed on an e/m actuator 4B so that the distances between the respective electromagnet and the steel sheet 1 can be adjusted individually.

Output signals from sensors 3A, 3B are input into a (vibration) controller 5, which also receives output signals from a sequencer 10. Output signals from the controller 5 are input into amplifiers 6A, 6B, and the output signals from amplifier 6A are input in the electromagnet 2A and the output signals from amplifier 6B are input in the electromagnet 2B.

Further, the output from the controller 5 is input into lowpass circuits 7A, 7B, whose output signals are input into a comparator 8. Output signals from the comparator 8 are input into an upper controller 9, whose output is input into electromagnetic (e/m) actuators 4A, 4B.

Next, the operation of the control apparatus will be explained. Sensor 3A detects the distance $d_A$ from its detection plane to the surface of the steel sheet 1 and transmits the result to the controller 5. Similarly, sensor 3B detects the distance $_B$, from its detection plane to the surface of the steel sheet 1 and transmits the result to the controller 5. The controller 5 outputs vibration control signals to amplifiers 6A, 6B according to the respective distance information received.

Amplifier 6A supplies excitation current $I_A$ to electromagnet 2A, and amplifier 6B supplies excitation current $I_B$ to electromagnet 2B, and the controller 5 controls amplifiers 6A, 6B in such a way that, if $d_A<d_B$, and if $d_A>d_B$, $I_A>I_B$. By so doing, the steel sheet 1 is always pulled back to the central location between the electromagnets 2A, 2B.

The controller 5 outputs the same control signal, as the control signal sent to the amplifiers 6A, 6B, to the lowpass circuits 7A, 7B, respectively. Lowpass circuits 7A, 7B allow only the low frequency components in the respective control signals to be transmitted. The low-frequency components are compared in the comparator 8, and the comparison results are sent to the upper controller 9. The upper controller 9 operates the e/m actuators 4A, 4B on the basis of the respective results received so as to move the electromagnets 2A, 2B accordingly.

These control actions ensure that, when the steel sheet 1 comes closer to one or the other of the electromagnets 2A, 2B, the location of steel sheet 1 is adjusted by either the e/m actuator 4A or 4B so that the sheet 1 is always retained in the central location relative to the electromagnets 2A and 2B.

Two methods of moving the A-and B-side electromagnets may be considered: one method is to move the electromagnets independent of the other, and the other method is to move the electromagnet on the A- and B-sides at the same time along a parallel line.

Figure 2B:
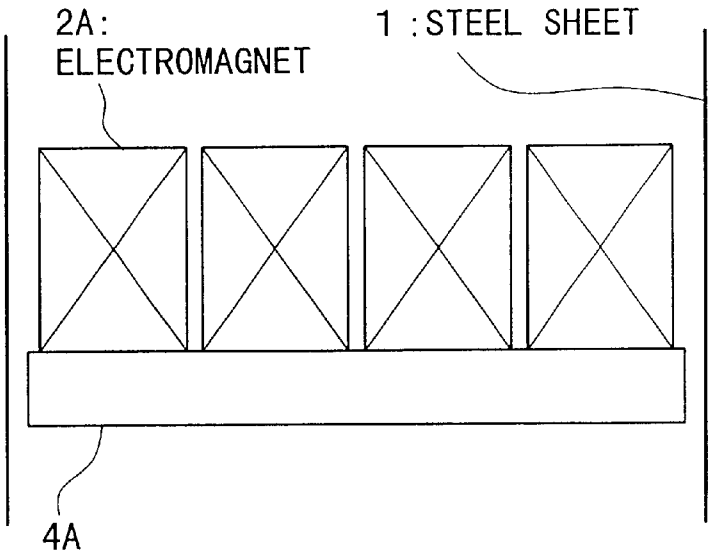
FIG. 2A, 2B are diagrams of an example of a plurality of pairs of electromagnets provided in the vibration control apparatus.
Figure 2A:
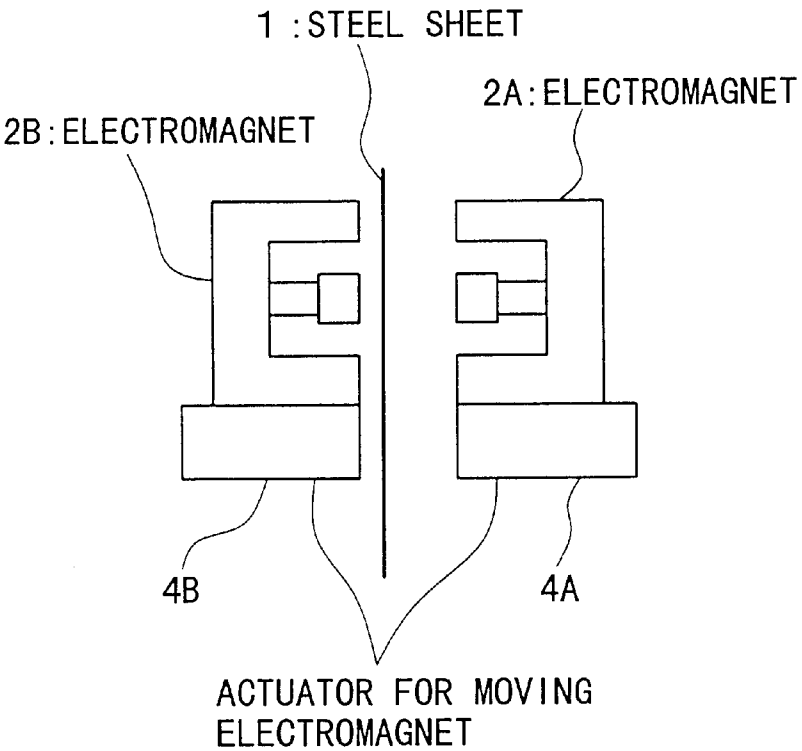

Or, when the electromagnets are arranged in the width direction of the steel sheet 1, as shown in FIG. 2A, 2B, they may be moved together.

Figure 3A:
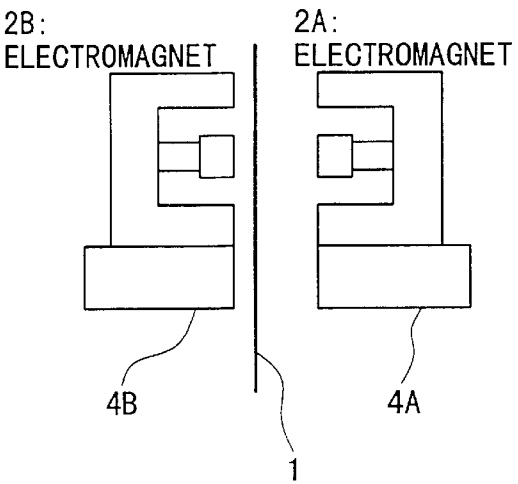
FIG. 3A~3C are diagrams to illustrate the operation of the vibration control apparatus in Embodiment 1.
Figure 3B:
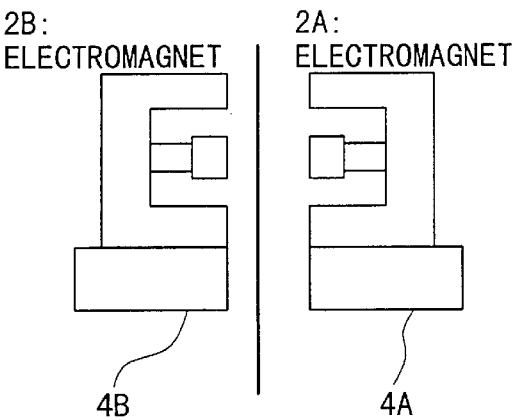

Accordingly, starting with the apparatus off and the sheet 1 is closer to the B-side, as illustrated in FIG. 3A, when the control apparatus is turned on to begin the vibration control process the following scenario may be experienced. Electromagnets 2A, 2B produce a centralizing force to bring the sheet 1 to the central location as illustrated in FIG. 3B. If the force of attraction being applied by the electromagnet 2A is too small for reasons such as the sheet 1 being too thick, a high excitation current flows in the electromagnet 2A while little current flows in the electromagnet 2B, and the control action becomes inoperative.

Figure 3C:
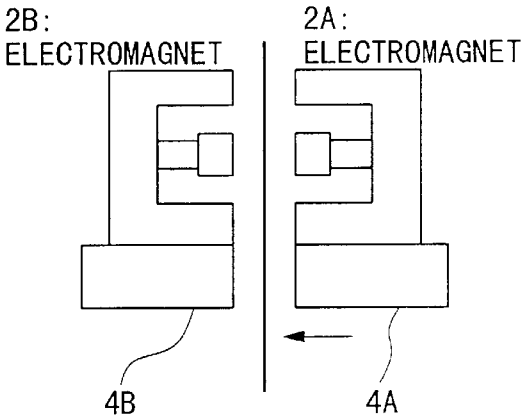

In such a situation, the e/m actuator 4A is operated to bring the electromagnet 2A closer to the sheet 1, as illustrated in FIG. 3C, the attraction force exerted by the electromagnet 2A increases to effect stable vibration control action.

In the above situation, the centralizing action can also be generated by moving the electromagnets 2A, 2B together to the left, without changing the interspacing of the electromagnets 2A, 2B. The construction of the apparatus may be simplified by providing one actuator to move both electromagnets 2A, 2B.

Figure 4:
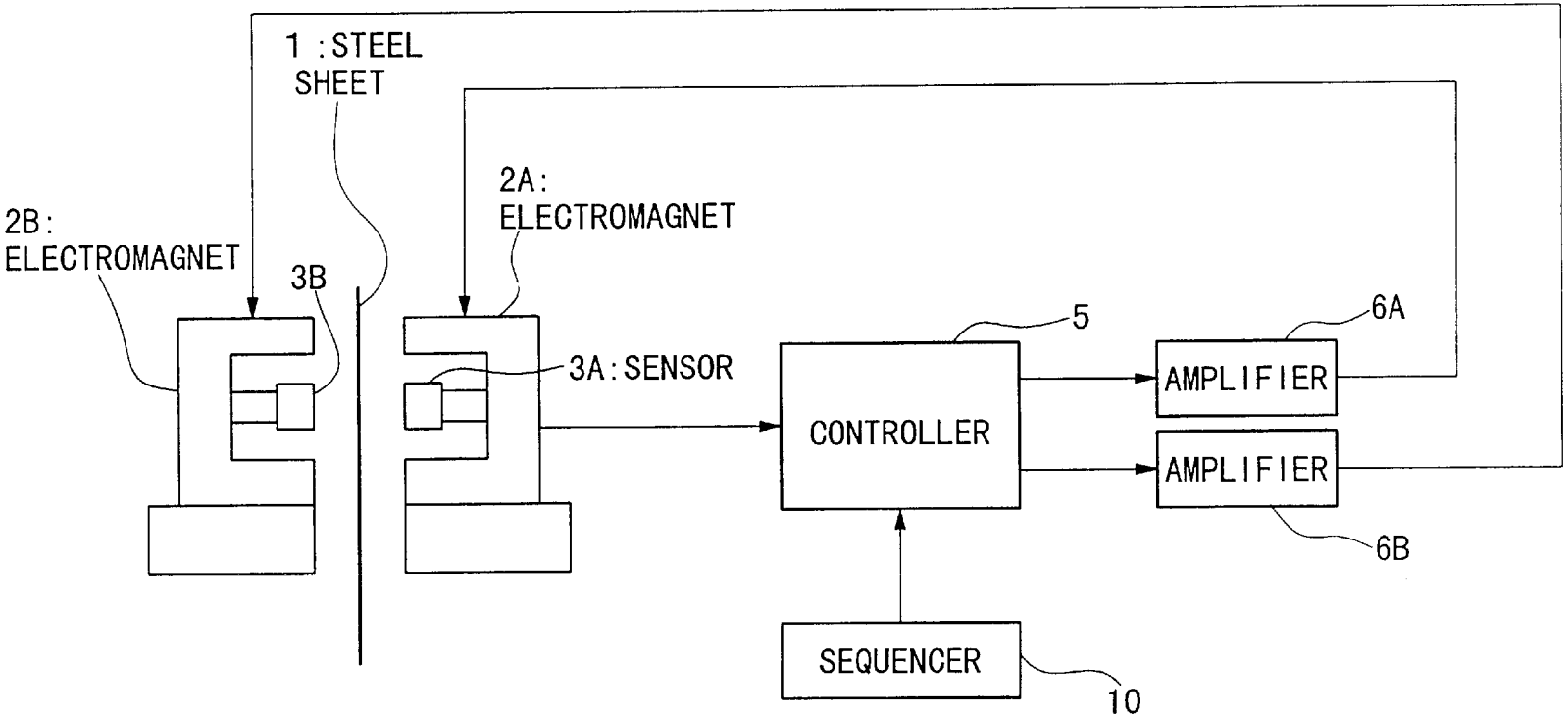
FIG. 4; is a schematic block diagram of the electrical control loop of the vibration control apparatus.

Next, the operation of the electrical control system will be explained. The electrical control loop section has been extracted from the overall control circuit, and is shown in FIG. 4.

Figure 5:
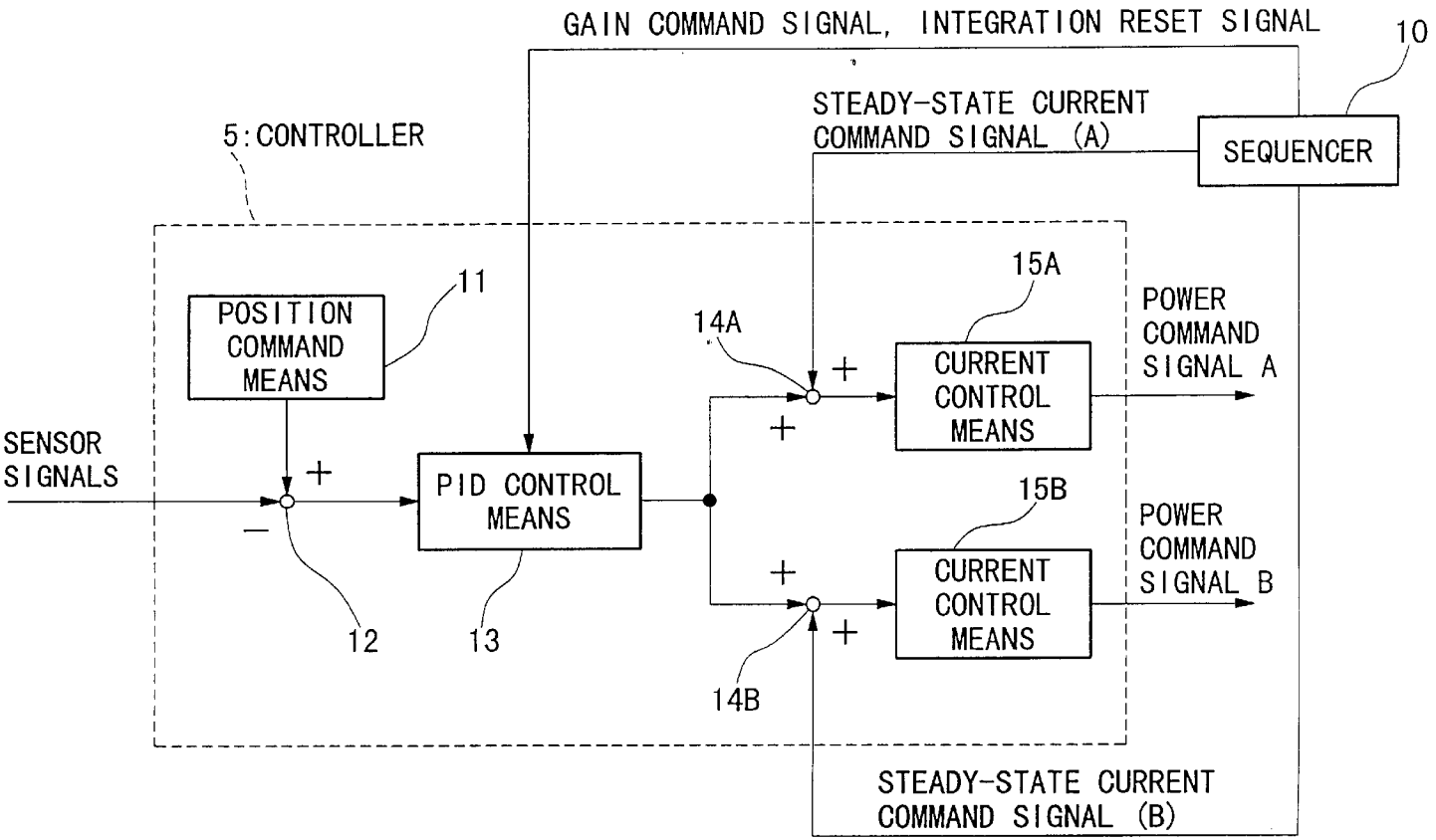
FIG. 5 is a block diagram of the internal structure of the vibration controller.

FIG. 5 shows the details of the internal structure of the vibration controller 5. Output signals from sensors 3A, 3B showing the location of the steel sheet 1 and output signals from the position command means 11 are input into the difference detection means 12, whose output signals are input into the proportional-integral-differential (PID) control means 13. The PID control means 13 also receives gain command signals and integration reset signals output from the sequencer 10.

Output signals from the PID control means 13 are input into the adder 14A, 14B, which also receive steady-state current command signals output from the sequencer 10. Output signals from the adder 14A are input into the current control means 15A, and output signals from the adder 14B are input into the current control means 15B. Output signals from the current control means 15A are input into the amplifier 6A, and output signals from the current control means 15B are input into the amplifier 6B.

Next, the sequence of operation taking place inside the controller 5 will be explained. A difference between the sensor signal showing the location of the steel sheet 1 and the position command signal output from the position command means 11 is computed by the difference detection means 12, and the computed difference is sent to the PID control means 13. The PID control means 13 outputs control signals according to the input difference value. The control signal and the steady-state current command signal output from the sequencer 10 are added in the adders 14A, 14B. The summed values are respectively input into the current control means 15A, 15B, which output respective power command signals to the amplifiers 6A, 6B.

Figure 6:
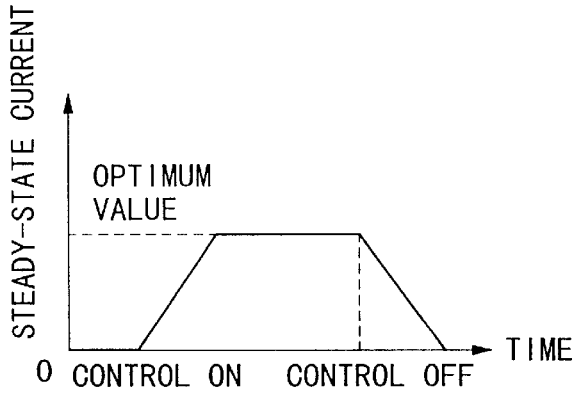
FIG. 6 is a graph to show changes in the steady-state current.

At the startup of the vibration control apparatus, the sequencer 10 outputs a steady-state current command signal so that the steady-state current input into electromagnets 2A, 2B will rise according to a ramp function as shown in FIG. 6. At this time, electromagnets 2A, 2B rises simultaneously to the level of steady-state current. Similarly, when stopping the apparatus, the electromagnets on both A- and B-sides are deactivated by following the same ramp function.

Figure 7:
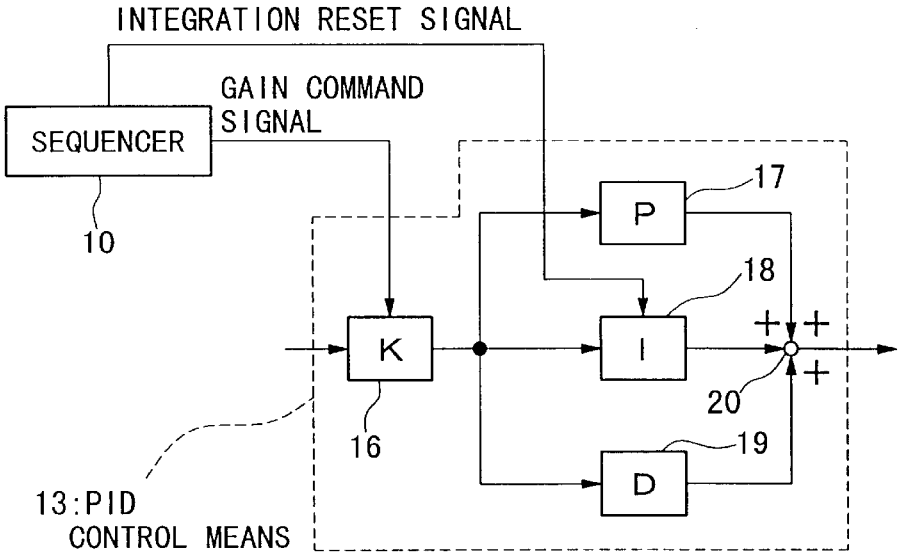
FIG. 7 is a block diagram of the internal structure of PID control means.

Next, detailed configuration of the PID control means 13 will be explained with reference to FIG. 7. The difference value output from the difference detection means 12 and the gain signal output from the sequencer 10 are input into the gain determination means 16, whose output is input into the ratio control means 17, integration control means 18 and the differentiation control means 19. The integration control means 18 receives an integration reset signal output from the sequencer 10. Output signals from the ratio control means 17, integration control means 18 and differentiation control means 19 are input into the adder 20, whose output is input into the adders 14A, 14B.

Figure 8:
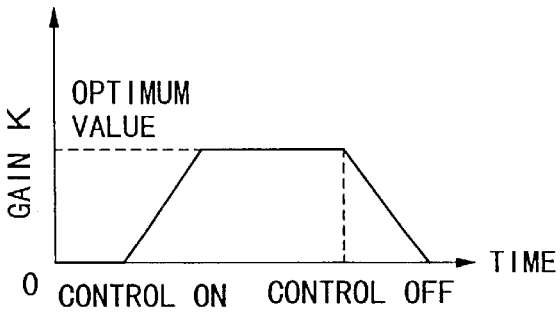
FIG. 8 is a graph to show changes in circuit gain caused by the control action.

Next, the operation of the PID control means 13 will be explained. Similar to the case of controlling the steady-state current to the electromagnets 2A, 2B, at the time of starting and stopping the vibration control apparatus, the sequencer 10 outputs a gain command signal to vary the gain K in the PID control means 13 according to a ramp function, shown in FIG. 8, to the gain determination means 16. The ratio control means 17, integration control means 18 and differentiation control means 19 control the excitation current in the electromagnets, according to a gain K determined by the gain determination means 16.

Figure 9:
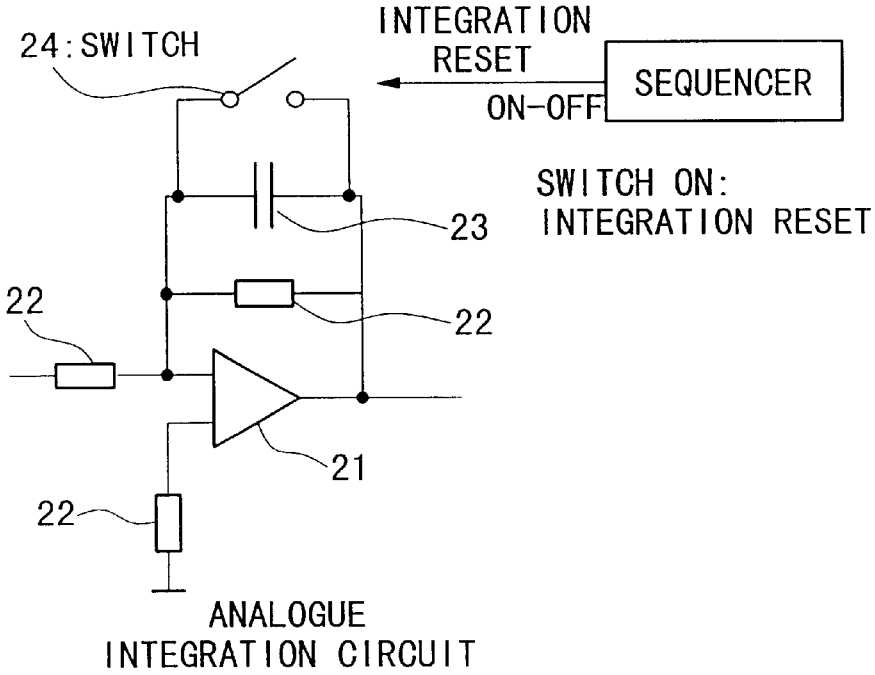
FIG. 9 is a schematic circuit diagram of analogue integration circuit in the integration control means.

Next, the detailed configuration inside the integration control means 18 will be explained with reference to FIG. 9. The integration control means 18 has an analogue integration circuit shown in FIG. 9, which is comprised by an amplifier 21, resistors 22, a condenser 23, and a switch 24 connected to both ends of the condenser 23.

Next, the operation of the integration control means 18 will be explained. The switch 24 is activated by the integration reset signal sent from the sequencer 10. The switch 24 is normally in the off-position, but when the integration reset signal is received, it shifts to the on-position to short the ends of the condenser 23, and resets the integration circuit.

At the time of starting the vibration control apparatus, an integration reset signal is sent from the sequencer 10 so that the switch 24 is turned on and the integration circuit is reset. Also, when the gain and steady-state current reach appropriate values, an integration reset signal is again sent to reset the integration circuit.

Figure 10A:
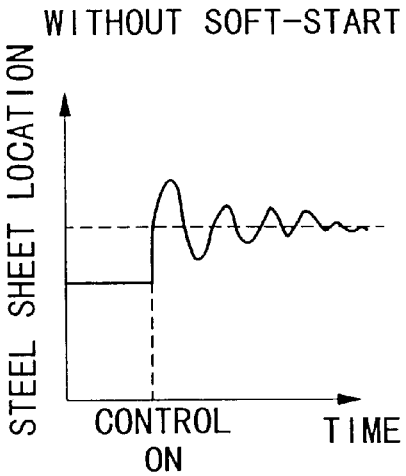
FIG. 10A, 10B are schematic illustration of the hunting phenomenon.
Figure 10B:
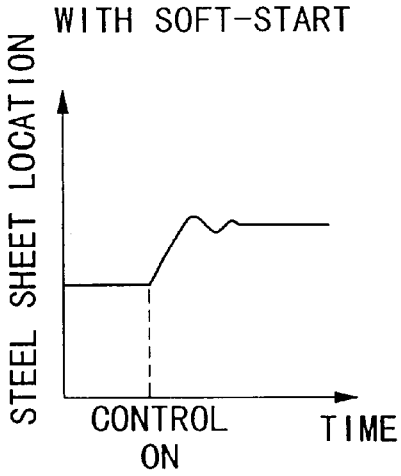

As described above, sudden increase in the excitation current is prevented, at the time of starting or stopping the apparatus, by varying the grain and steady-state current according to a ramp function, or by resetting the integrated value of the integration circuit, so as to eliminate hunting phenomenon, such as the one illustrated in FIG. 10A, and to enable to soft-start the apparatus in a stable manner as illustrated in FIG. 10B, for example.

Next, the operation of starting the electrical control while bringing the electromagnets closer to the steel sheet will be described. At the time of starting the vibration control apparatus, the electromagnets are moved from their initial positions to positions to create suitable gaps to the steel sheet, and based on the time internals required to move to these positions, the parameters for the soft-start operation, such as the steady-state current, gain and the rate of increase (slope) for the ramp function, are selected.

Figure 11:
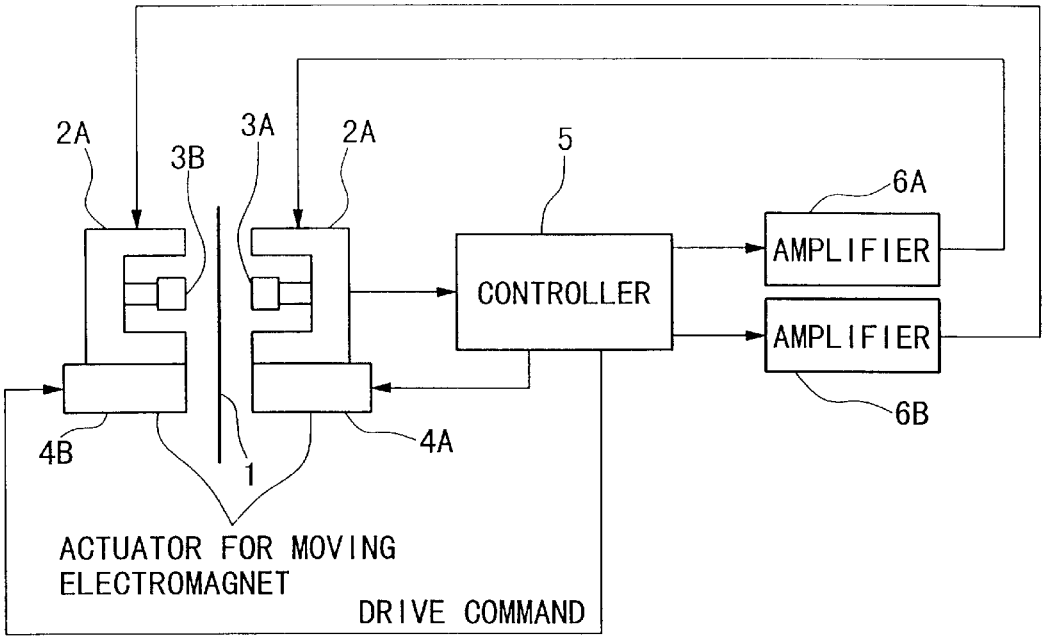
FIG. 11 is a schematic diagram of a configuration used for mechanical and electrical control methods.

FIG. 11 shows a block diagram for only that part of the configuration to carry out the above-mentioned steps. The (vibration) controller 5 generates a system-start signal to operate the e/m actuator 4A, 4B to move the electromagnets 2A, 2B closer to the steel sheet 1. At the same time, the controller 5 gradually increases the steady-state current portion of the excitation current to be supplied to the electromagnets 2A, 2B and the controlling gain for the excitation current to be supplied to the electromagnets 2A, 2B through the amplifiers 6A, 6B.

Figure 12A:
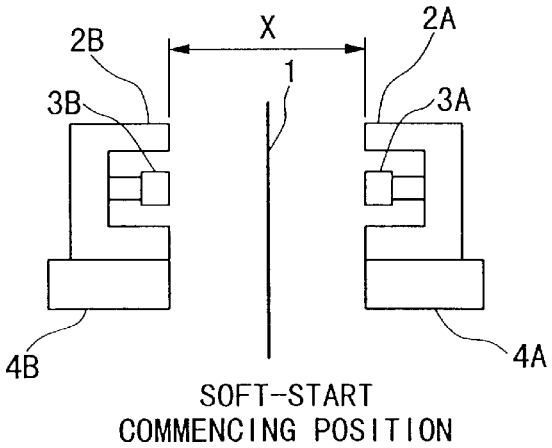
FIG. 12A, 12B are diagrams illustrating the locations of the electromagnets for soft start.
Figure 12B:
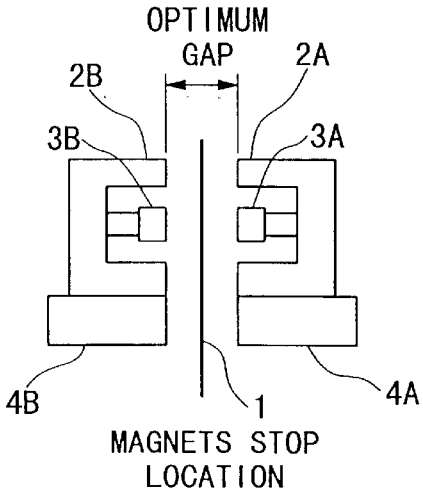

When the vibration control apparatus is started, the opposing electromagnets 2A, 2B are moved, at the same time, by the e/m actuators 4A, 4B in the direction to approach the steel sheet 1, and when the inter-magnet distance between the electromagnets reach a certain value X as shown in FIG. 12A, the soft-start operation is commenced to gradually increase the gain and the steady-state current, and when an appropriate distance is reached as shown in FIG. 12B, the soft-start operation is ceased, and the vibration control apparatus transfers to a steady-state operation.

Figure 13A:
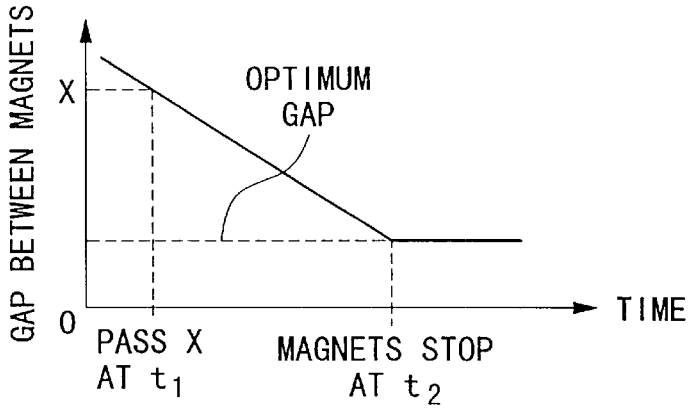
FIG. 13A, 13B are graphs to show the changes in gain and steady-state current during soft start.
Figure 13B:
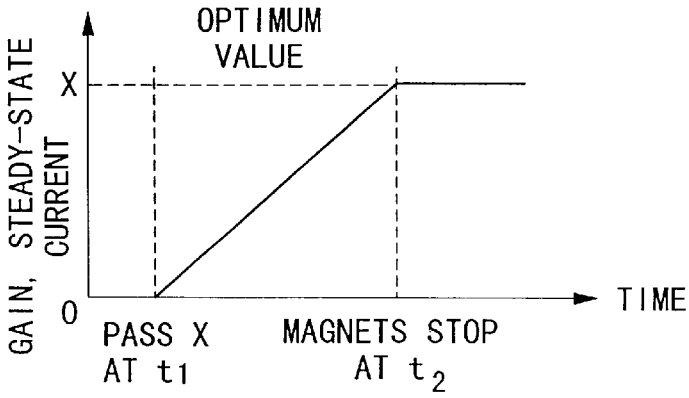

In this case, as shown in FIGS. 13A, 13B, the time constant of the soft-start operation (i.e., the slope of the ramp function) is determined so that the gain and steady-state current will be at the appropriate values when the inter-magnet distance reaches an appropriate value.

Similarly, when the apparatus is to be stopped, soft-stop operation is used to separate the electromagnets gradually.

In the embodiment described above, the integration is performed using analogue circuits but is possible to carry out these operations using digital circuits or application softwares.

Embodiment 2

Figure 14:
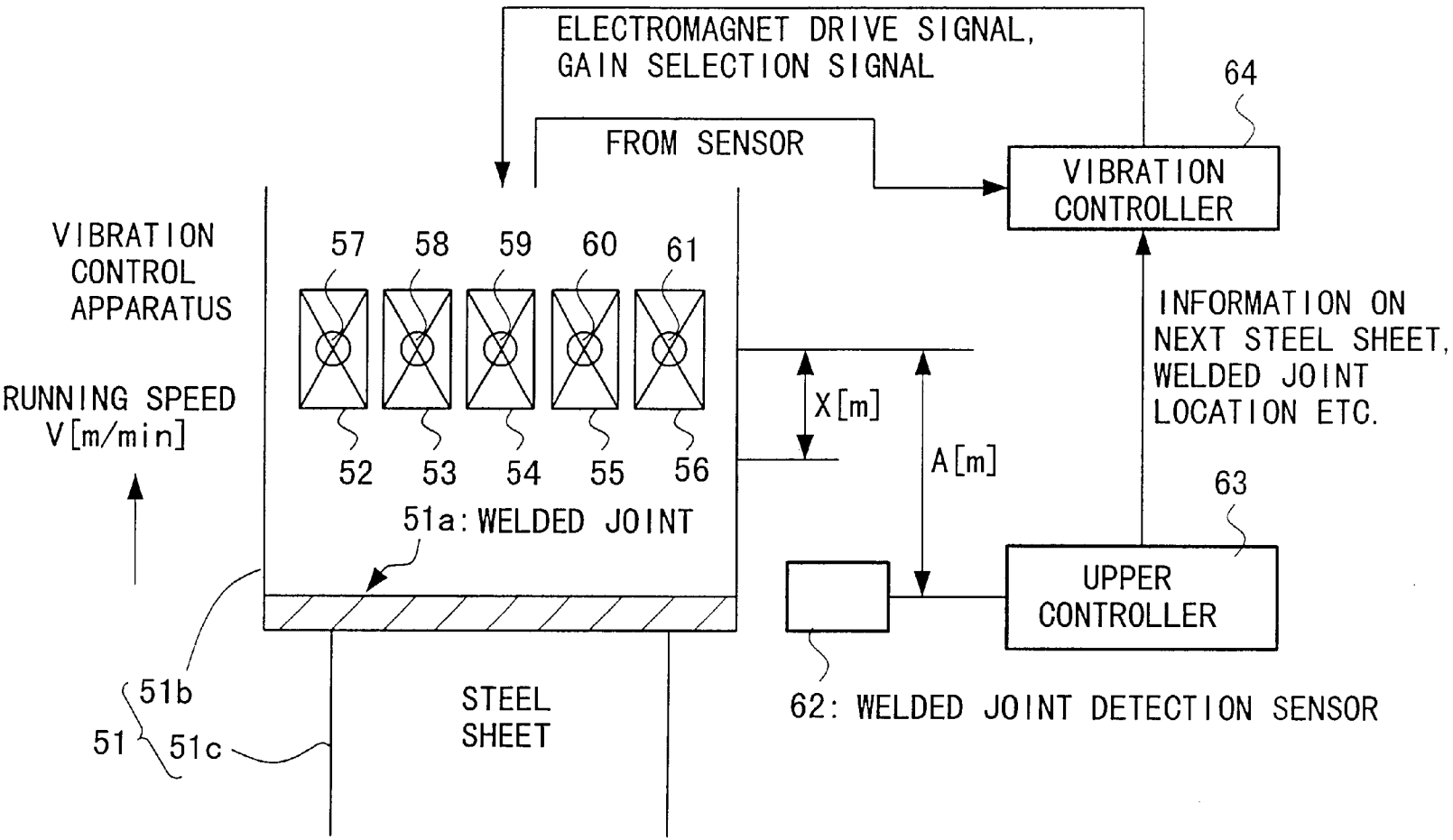
FIG. 14 is a block diagram of the vibration control apparatus in Embodiment 2.

FIG. 14 shows Embodiment 2. In the diagram, the steel sheet 51 runs vertically from the bottom to top of the diagram at a running speed V m/min, and the electromagnet pairs 52~56 are arranged transversely to the steel sheet 51. Each of the electromagnet pairs 52~56 is provided with respective internal sensor pairs 57~61.

Figures 15, 16:
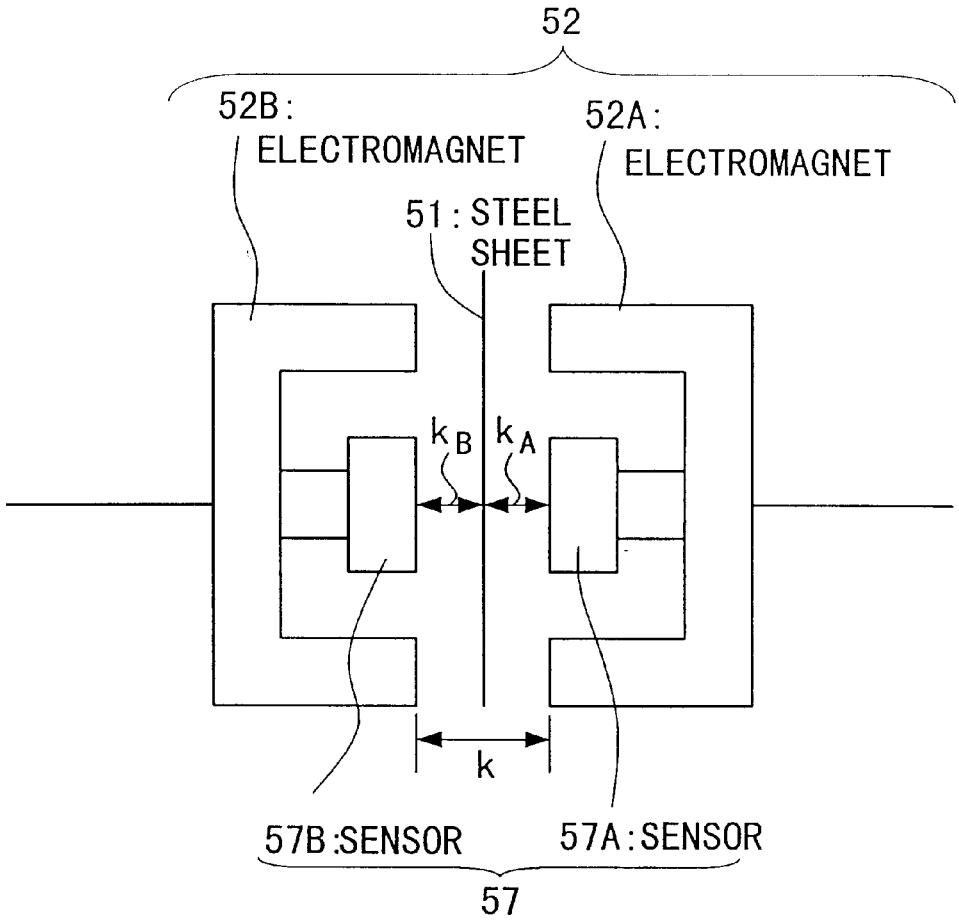
FIG. 15 is a side view of a pair of electromagnets.
FIG. 16 is a table for PID gain.

FIG. 15 shows a side view of the electromagnet pair 52 and the steel sheet 51. The electromagnet pair 52 is comprised by an electromagnet 52A on the front-side and an electromagnet 52B on the back-side of the steel sheet 51 disposed in such a way to oppose each other. The electromagnet pairs 53~56 have the same structure.

The sensor pair 57 housed in the electromagnet pairs 52 is comprised by a sensor 57A housed in the electromagnet 52A disposed on the front-side of the steel sheet and a sensor 57B housed in the electromagnet 52B disposed on the back-side of the steel sheet and are disposed in such a way to oppose each other. Sensor pairs 58~61 have the same structure.

Returning to explanation of FIG. 14, a weld joint detection sensor 62 is located A cm away from the transverse line of the electromagnet pairs 52~56, in the opposite direction to the running direction of the steel sheet 51, for detecting the presence of welded joint 51*a*.

Output signals from the weld joint detection sensor 62 are input into the upper controller 63, whose output is input into the vibration controller 64. Output signals from the controller 64 are input into the electromagnet pairs 52~56, and output signals from the sensor pairs 57~61 housed in the electromagnet pairs 52~56 are input into the vibration controller 64.

In the vibration controller 64, various information regarding the steel sheet to be processed, such as presence or absence of welded joints, the width of the steel sheet ahead of the welded joint, the width of the steel sheet following the welded joint, is stored in a table form. Driving parameters for the electromagnets are altered according to the contents in the table and the timing of welded joint detection.

Next, the operation of the vibration control apparatus will be explained. Sensor pairs 57~61 detect the separation distance between the electromagnet pairs 52~56 and the steel sheet 51. In more detail, the sensor disposed on the front-side of the sheet 51, for example the sensor 57A in FIG. 15, detects the separation distance $k_A$ to the front surface of the steel sheet 51, and the sensor disposed on the back-side of the sheet 51, for example the sensor 57B in FIG. 15, detects the separation distance $k_B$ to the back surface of the steel sheet 51. Here, the detection surfaces of the sensors 57A, 57B are coplanar with the pole surface of the electromagnets 52A, 52B. The vibration controller 64 controls the electromagnet pairs 52~56 according to the distances detected by the sensor pairs 57~61 so as to control vibration of the steel sheet 51.

If a welded joint 51*a* joining two different kinds of steels is detected in the running steel sheet 51 by the welded joint detection sensor 62, the detected signals output from the welded joint detection sensor 62 are sent to the upper controller 63, which outputs a control signal to the vibration controller 64. Then, the controller 64 soft-stops the electromagnet pairs 52 and 56 when the welded joint 51*a* of the sheet 51 is at a point X m back of the transverse line of electromagnet pairs 52~56, thereby ceasing the operation of the electromagnet pairs 52 and 56.

The sheet-stopping electromagnet pairs are predetermined and stored in the vibration controller 64 according to the information input into therein. That is, in this case, the width of the sheet 51*b* preceding the weldedjoint 51*a* and the width of the sheet 51*c* succeeding the welded joint 51*a* have been input into the controller 64, so that the sheet-stopping pair of electromagnets and those electromagnet pairs to be operated are determined on the basis of the installed positions of the electromagnet pairs 52~56 in conjunction with the pre-input information.

After the steel sheet 51 has passed the transverse line of the electromagnet pairs 52~56, the vibration controller 64 renews the PID gain for controlling the electromagnet pairs 53~55 according to the information such as the width and thickness of the steel sheet 51*c* that follows the welded joint 51*a*.

More specifically, when an interval (A-X)/V min has elapsed after the welded joint 51*a* has passed the welded joint detection sensor 62, the electromagnet pairs 52 and 56 are subjected to soft-stopping, i.e., a gradual lowering of the steady-state current and the PID gain.

At this point, based on the information such as sheet thickness and width of the steel sheet 51*c* that follow the previous steel sheet, the values of the PID gain for the electromagnet pairs 53~55 are selected and after an elapsed interval of X/V min, the control mode is switched to the soft-mode.

The PTD gain is determined according to the sheet thickness in conjunction with a table, such as the one shown in FIG. 16, stored in the vibration controller 64. If the values stored in the table do not match the input value, a PID gain can be computed by interpolation of the neighboring values.

Embodiment 3

Figure 17:
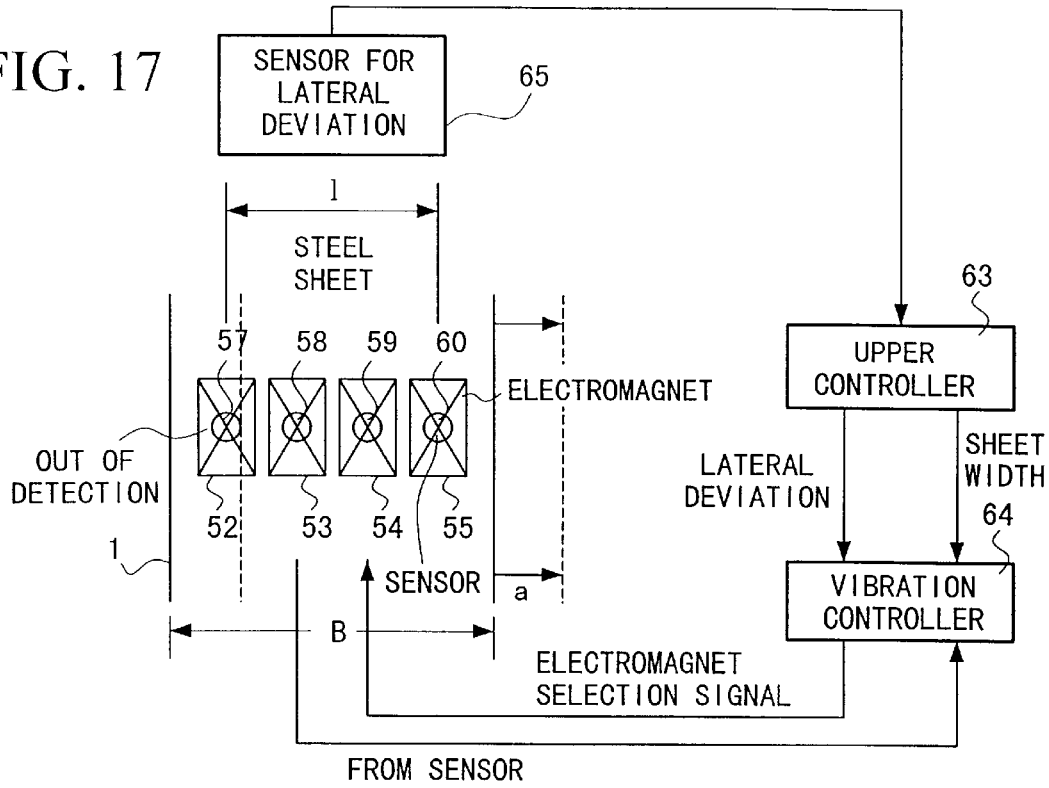
FIG. 17 is a block diagram of the vibration control apparatus in Embodiment 3.

Next, a vibration control apparatus in Embodiment 3 will be explained with reference to FIG. 17. The steel sheet 51 travels from the bottom of the diagram towards the top of the diagram. A line of electromagnet pairs 52~55 housing sensor pairs 57~60 are arranged transversely to the steel sheet 51. The structures of the electromagnets pairs 52~55 and the sensor pairs 57~60 are the same as those in Embodiment 2.

In this apparatus, an optical or magnetic displacement sensor 65, disposed above the sheet 51, detects snaking of the steel sheet 51 as a lateral left/right shift in the position of the steel sheet 51, which is transverse to the travel direction of the steel sheet 51. Output signals from the displacement sensor 65 are input into the upper controller 63, whose output is input in the vibration controller 64. Output signals from the controller 64 are input into the electromagnet pairs 52~55. Output signals from the sensor pairs 57~60 housed in the respective electromagnets pairs 52~55 are input into the controller 64. The sensor pairs 57~60 are placed in the center of the respective electromagnet pairs 52~55.

Next, the operation of the vibration control apparatus will be explained. The displacement sensor 65 successively detects the amount of lateral displacement of the running steel sheet 51, and the detected results are successively input into the upper controller 63. The upper controller 63 transmits the detected displacements and the pre-input information on sheet widths to the vibration controller 64.

The vibration controller 64 computes the location of the edge of the sheet 51 from the lateral displacement information and the sheet width information, and determines the electromagnet pairs to be operated based on the computed edge location information and the positions of the electromagnet pairs 52~55.

Designating the center-to-center distance of the sensors 57, 60 by L, sheet width by B, outer diameter of the sensor head by D, and lateral shift by "a" (positive for a shift to the right), when $a>0$ and $B-a<L+2D$, the left-side electromagnet pair 52 is soft-stopped, and when $a<0$ and $B+a<L+2D$, the right-side electromagnet pair 50 is soft-stopped. The value of "a" should be less than the distance between the pair of electromagnets.

Embodiment 4

Next, a vibration control apparatus in Embodiment 4 will be explained. This apparatus is the same as the one shown in FIG. 17 in Embodiment 3. In this apparatus, shown in FIG. 19, an adder circuit 71 is provided to sum the output values from the front-side and back-side sensors. When the summed value computed by the adder circuit 71 exceeds a threshold value, the electromagnet pairs corresponding to the sensor pairs are soft-stopped.

Figure 18:
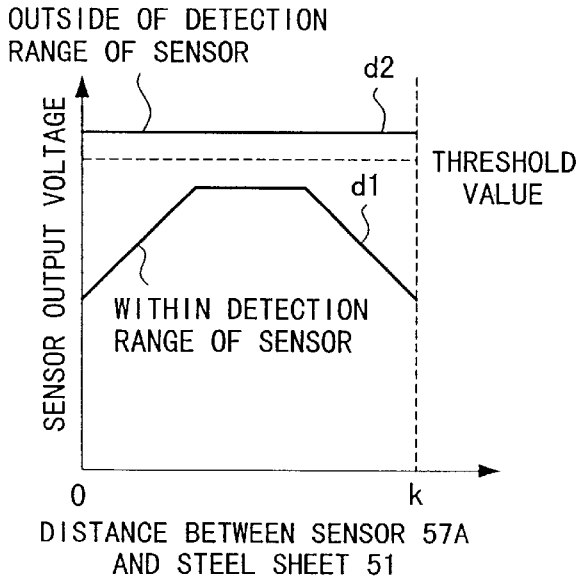
FIG. 18 is a graph showing a relationship between the sensor output and threshold values.

Specifically, as shown in FIG. 15, when the steel sheet 51 is present between the sensor 57A and sensor 58B, respective distances to the steel sheet 51 can be determined. In this case, the output signal d1 from the sensor 57A is below a certain threshold value, as seen in FIG. 18. However, when the sheet 51 moves out of the space defined by the sensor pairs, output signals d2 from the sensor 57A produce a constant value exceeding the threshold value, as seen in FIG. 18.

Figure 19:
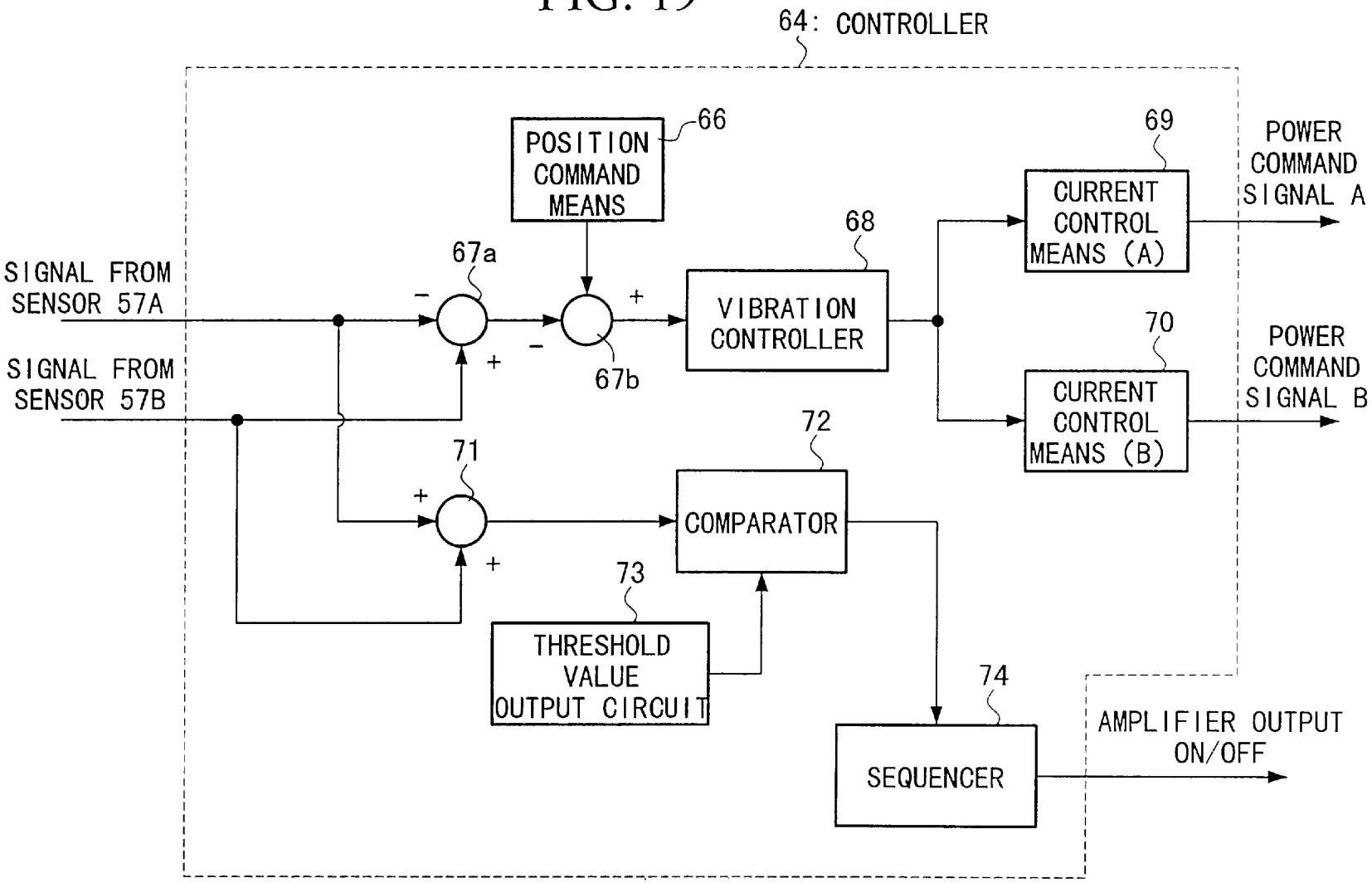
FIG. 19 is a block diagram to shown the details of the internal structure of the vibration controller.

The detailed configuration of the internal structure of the vibration controller 64 is shown in FIG. 19. The controller 64 receives signals from the sensors 57A and 57B. These signals are input into a subtraction circuit 67*a* inside the controller 64 to compute a difference value between the two signals. A subtraction circuit 67*b* is provided to obtain a difference between the computed difference and the value provided by the position command circuit 66. Output signals from the subtraction circuit 67*b* are input into the vibration controller 68. Output signals from the vibration controller 68 are input into a current control means (A) 69 and a current control means (B) 70. Output signals from the current control means (A) 69 and the current control means (B) 70 are input into electromagnet 52A, 52B, respectively, to operate each electromagnet.

Also, the signals from the sensor 57A, 57B to be input into the vibration controller 64 are also input into the adder circuit 71. Output signals from the adder circuit 71 are input into the comparator 72, where it is compared against the threshold value output from the threshold output means 73. Output signals from the comparator 72 are input into the sequencer 74, which outputs on/off control signal.

It should be noted that the descriptions given above relate to the electromagnet pairs 52 and sensor pairs 57, but similar circuits are provided for the electromagnet pairs 53~55 and sensor pairs 58~60.

Next, the operation of the vibration controller 64 will be explained. Here, the operation of the circuits related to only the electromagnet pairs 52 and sensor pairs 57 will be explained using FIG. 19, and explanations regarding similar operations of the electromagnet pairs 53~55 and sensor pairs 58~60 will be omitted.

The difference between the distance signals from the sensors 57A and 57B is computed by the subtraction circuit 67*a*. This value represents a displacement value of the steel sheet 51 from the central position between the sensors 57A, 57B. A difference between this value and the position value given by the position command means 60 is computed by the subtraction circuit 67*b*. The difference between the actual displacement and the command position is sent to the vibration controller 68, which controls the current control means (A) 69 and the current control means (B) 70 according to the difference between the command value and the actual displacement value. The current control means (A) 69 and the current control means (B) 70 operate the respective electromagnets 52A and 52B. Accordingly, the steel sheet 51 is controlled so that its location coincides with the command value.

The distance values from the sensors 57A, 57B are input into the adder circuit 71 also to compute the sum of the distance values. The summed value is compared against the threshold value output from the threshold value output means 73, and the result of comparison is forwarded to the sequencer 74. When the summed value is greater than the threshold value, the sequencer 74 judges that the steel sheet 511 is not present between the sensor pairs 57, and turns off the electromagnets pairs 52 housing the sensor pair 57. When the power is turned off, control actions by the current control means (A) 69 and the current control means (B) 70 are nullified. When the summed value is less than the threshold value, it is judged that the steel sheet 51 is present between the sensor pairs 57, and the electromagnet pairs 52 are turned on. When the power is turned on, control actions by the current control means (A) 69 and the current control means (B) 70 are activated.

Figure 20:
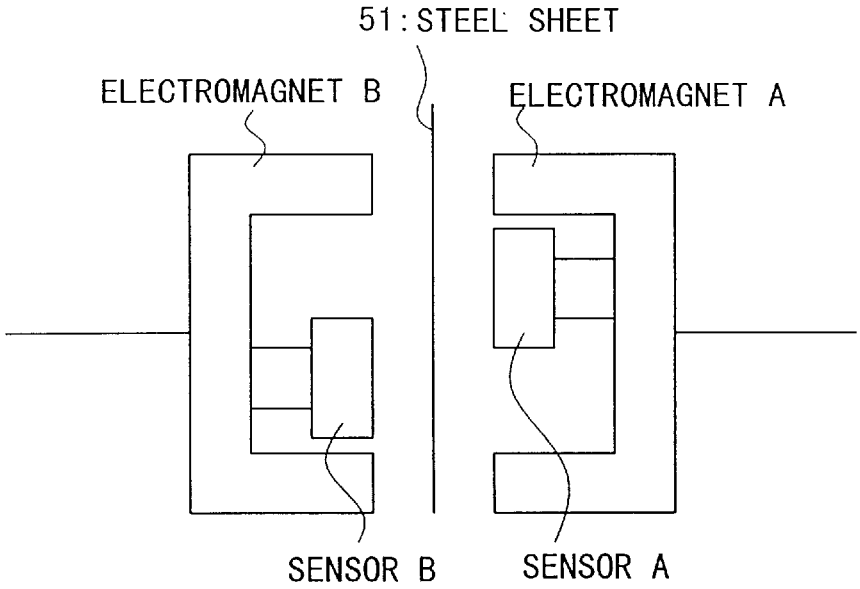
FIG. 20 is a side view of another pair of electromagnets.

It should be noted that other arrangements of the sensor pair are permissible as exemplified in FIG. 20. In this case, sensors A, B are shifted relative to the other so that they are not opposite to each other. This arrangement enable to avoid a situation caused by mutual interference of the opposing sensors that the sum of the sensor output values when the sheet 51 is not present is less than the sum of the sensor output values when the sheet 51 is present.

Embodiment 5

Figure 21:
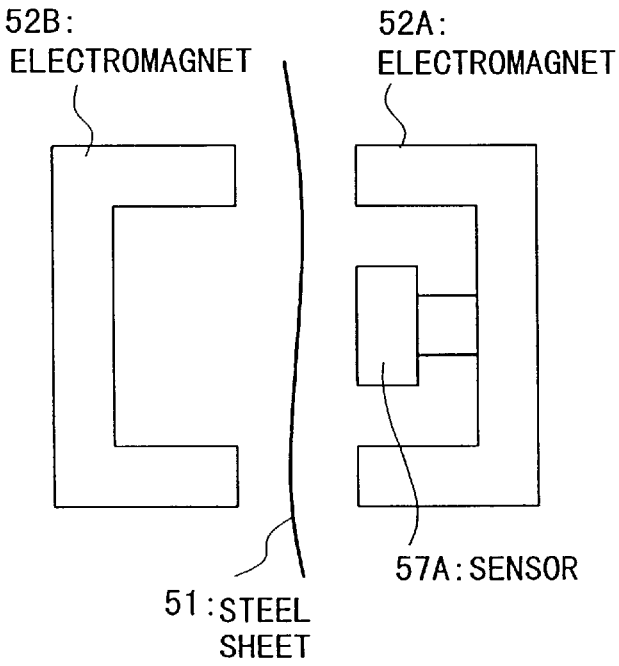
FIG. 21 is a block diagram of the vibration control apparatus in Embodiment 5.

Next, a vibration control apparatus in Embodiment 5 will be explained with reference to FIG. 21. As shown in FIG. 21, vibration control electromagnets 52A, 52B are provided opposite to each other on both sides of the steel sheet 51. A sensor 57A is provided in one of the electromagnet 52A. A plurality of pairs of electromagnets may be provided in some cases in either the longitudinal or transverse direction to the steel sheet 51.

Figure 22:
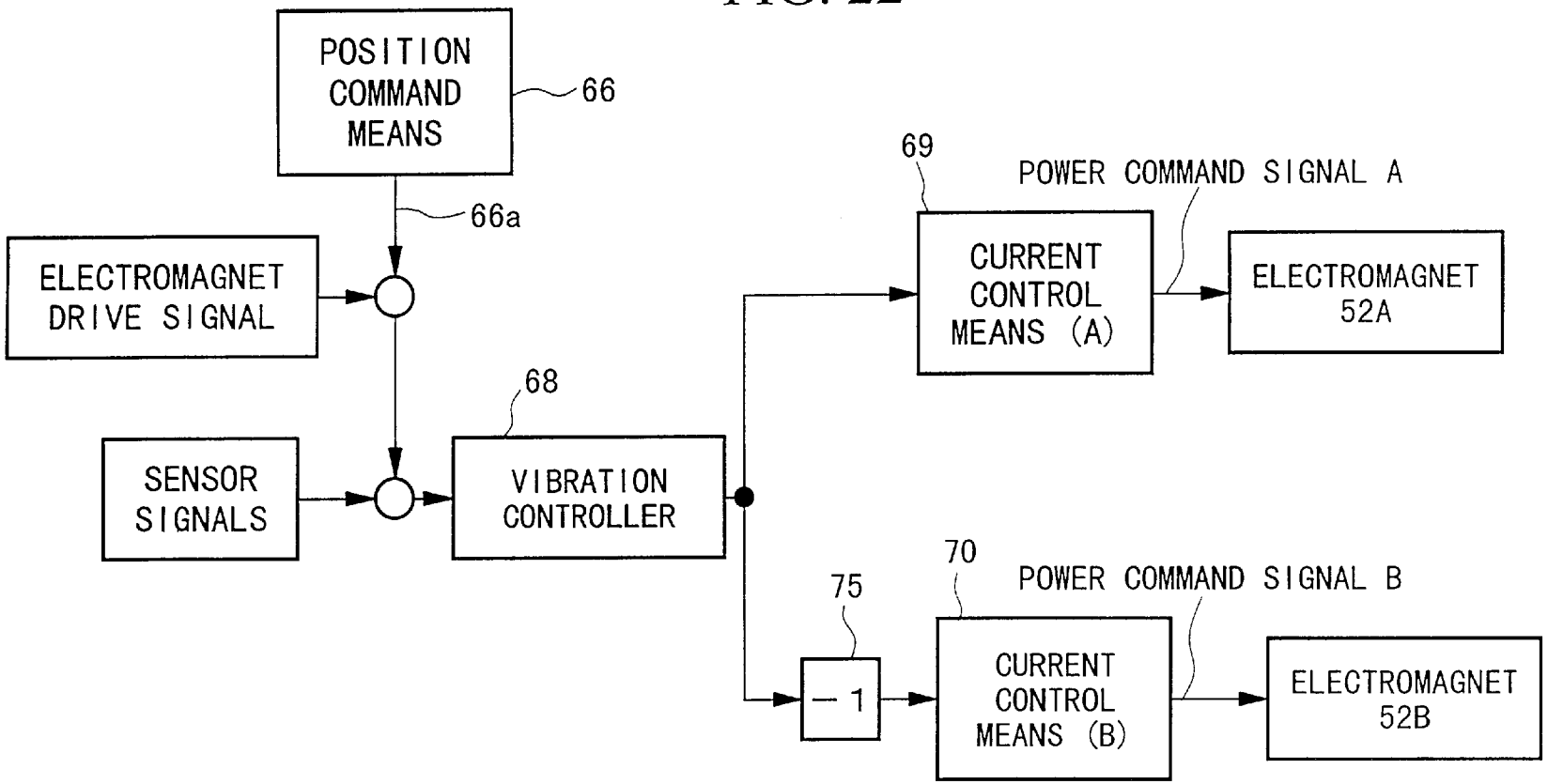
FIG. 22 is a block diagram of the control system in Embodiment 5.

FIG. 22 shows a structure of the vibration control apparatus in Embodiment 5. The parts in FIG. 22 that are the same as those in FIG. 19 are give the same reference numerals, and their explanations are omitted. In this apparatus, because an inversion means 75 is provided between the vibration controller 68 and the current controlling means (B) 70, electromagnets 52A and 52B are controlled in opposite manners. For example, when the driving current to the electromagnet 52A is being increased, the driving current to electromagnet 52B is being decreased.

Figure 23:
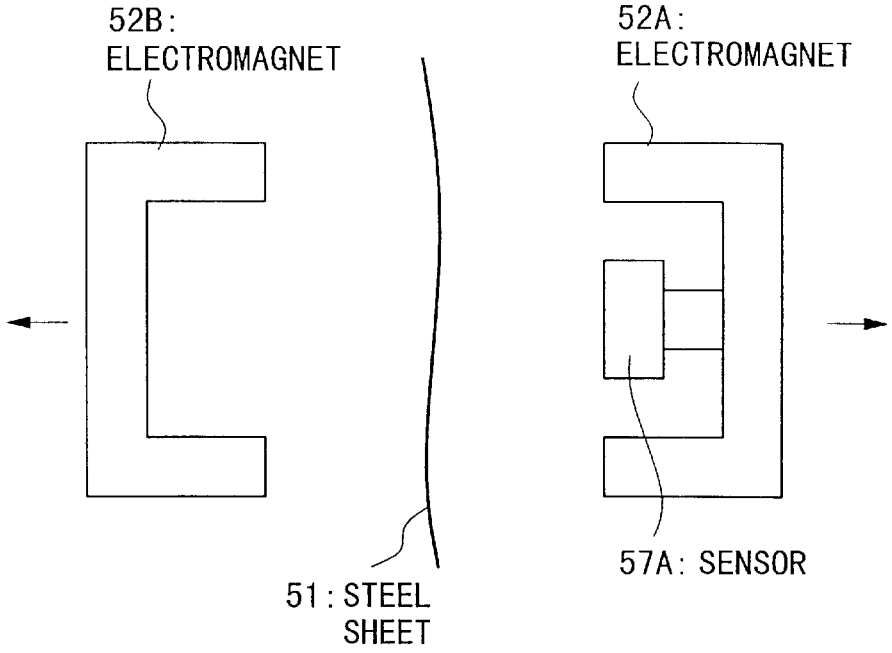
FIG. 23 is an illustration of the electromagnets moving to the standby position.

Next, the operation of the apparatus will be explained. A welded joint represents a region of change in the running sheet from one type of steel to another type of steel, so that the weld section may be deformed or the sheet width may be quite different in the steels that is ahead of and following the welded joint. Therefore, there is a possibility that the deformed section can collide with the vibration control devices. To avoid such a situation, the electromagnets 52A and 52B are retreated from the sheet 51 to a standby position, that is, in a direction away from the back and front surfaces of the steel sheet 51, as shown in FIG. 23.

In such a case, the position command signal 66*a* in the control system, shown in FIG. 22, is altered according to the distance of movement of the sensor 57A in the electromagnet 52A. That is, when the electromagnet 52A is pulled away from the steel sheet 51, the sensor 57A is also pulled away from the sheet 51, and therefore, even though the location of the steel sheet 51 itself has not changed, the apparent location of the sheet 51 seen by the sensor 57A is changed. The position command signal 66*a* is altered in accordance with the apparent change.

Accordingly, there would be no generation of magnetic forces to counter the movement of the steel sheet away from the electromagnet, and therefore, vibration control action can be continued during the standby operation without causing over-heating or damage to the electromagnets.

Embodiment 6

Figure 24:
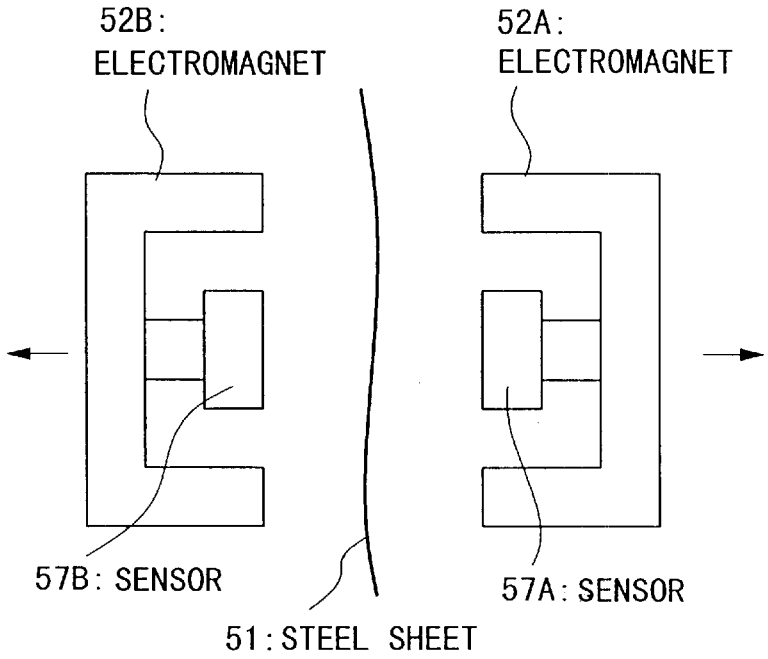
FIG. 24 is a side view of the vibration control apparatus in Embodiment 6.
Figure 25:
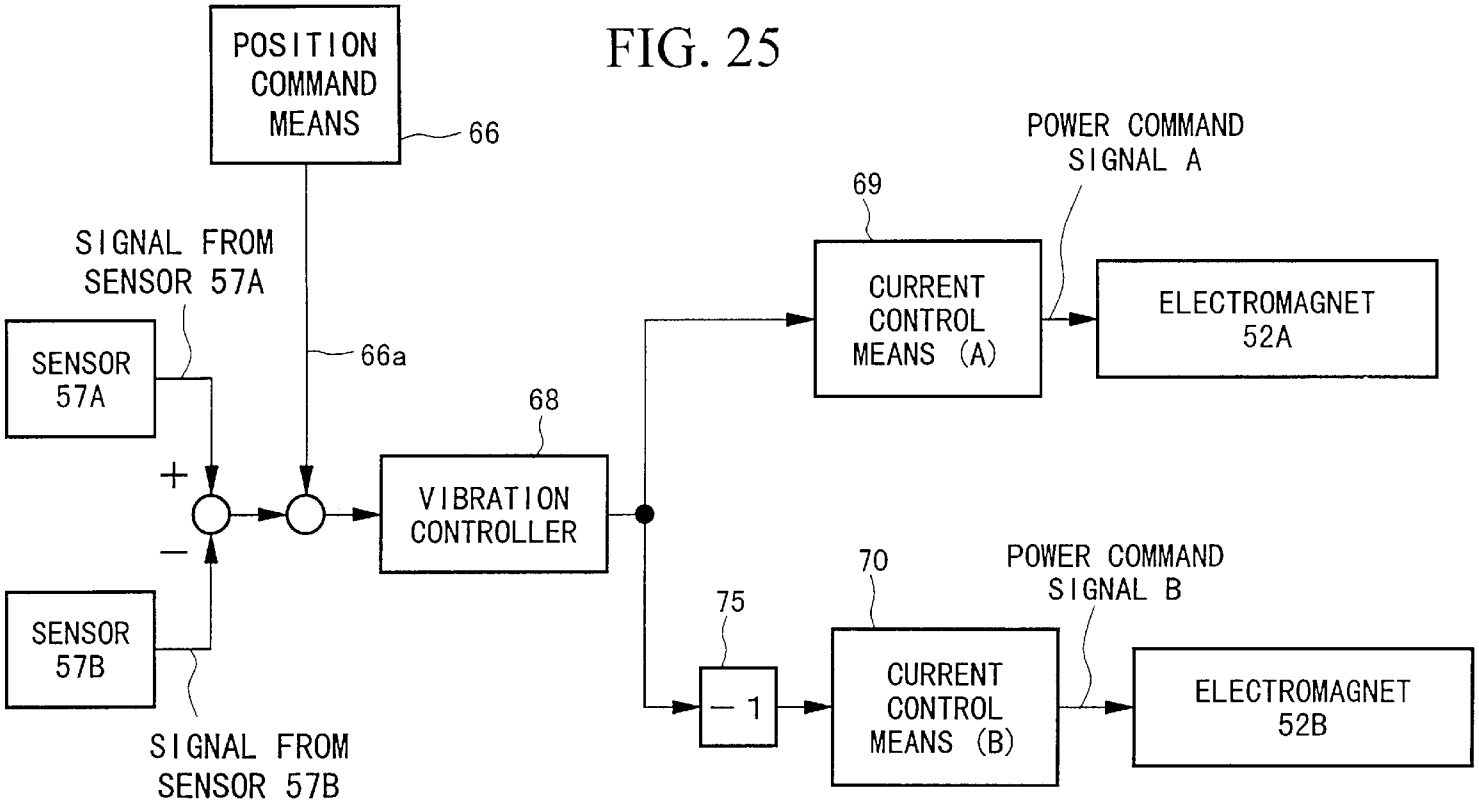
FIG. 25 is a block diagram of the control system in Embodiment 6.

Next, a structure of the vibration control apparatus in Embodiment 6 will be explained with reference to FIG. 24. In this apparatus, sensors 57A, 57B are provided in the interior of the electromagnets 52A and 52B positioned on both sides of the steel sheet 51. The control system for the apparatus is shown in FIG. 25.

According to this arrangement, a trigger value for the position command signal can be based on the difference in the distances from the steel sheet 51 to the sensor 57A and 57B. Therefore, the trigger value is zero when the steel sheet 51 is located exactly midway between the sensors 57A, 57B.

By adopting such a control structure, even during the interval of pulling the electromagnets 52A and 52B to the standby position, the trigger value may be left at zero to maintain the steel sheet 51 in the mid-position so that unnecessary magnetic forces are not generated and the vibration control action can be continued while carrying out the standby operation.

Figure 26:
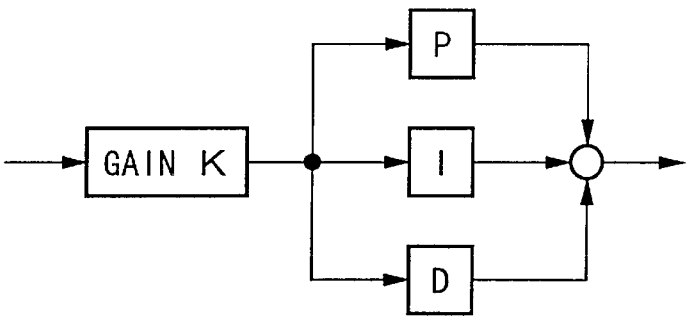
FIG. 26 is a block diagram to show the internal structure of the vibration controller.
Figure 27:
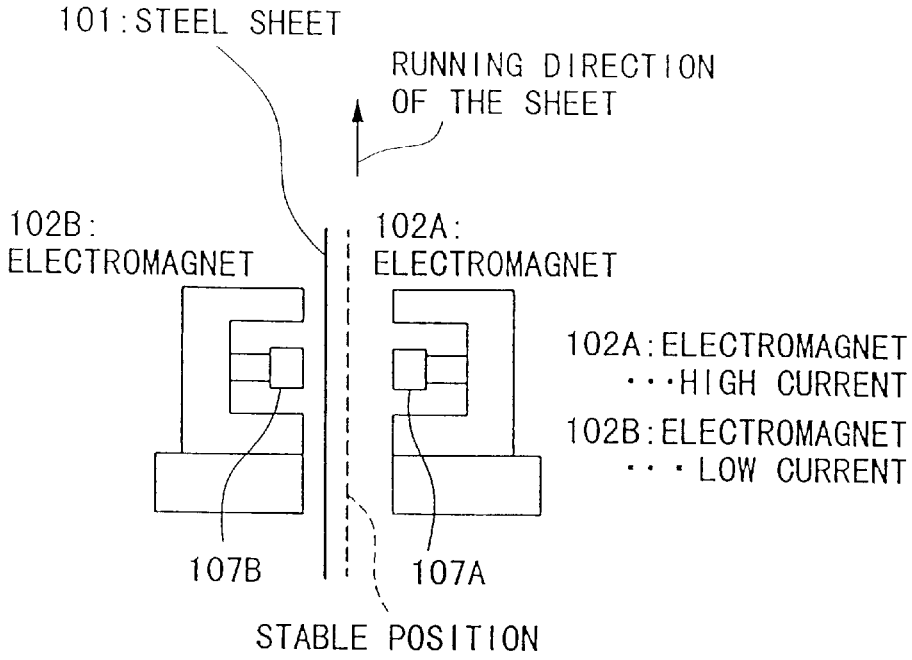
FIG. 27 PRIOR ART
FIGS. 27, 28 are schematic diagrams of conventional vibration control apparatuses.
Figure 28:
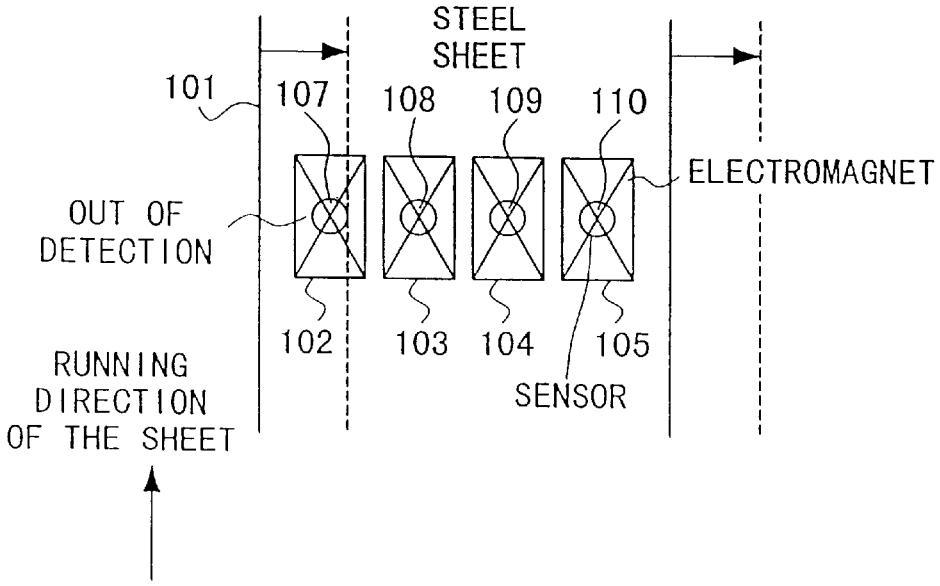
FIG. 28 PRIOR ART

In each of the embodiments presented in the foregoing embodiments, the vibration control means 68 is operated according to the proportional-integral-differential (PID) control shown in FIG. 26. The I-control (integral-control) mode operates in such a way to decrease the deviation between the command value and the actual sheet position value. However, in carrying out the standby process, as the sensors are pulled away from the sheet, the sensors move away from the sheet, and when the separation distances exceed the detection distance of the sensors, the I-control action can start to operate to increase the excitation current to the magnetic coils.

Therefore, during the standby operation including retreat- and return-periods, the I-control is turned off to prevent excess current to flow in the apparatus. During the retreating and returning operations, I-control naturally cannot be carried out, but the lack of I-control is not critical during such times, because precise control of the sheet position is often not required although the overall vibration control can still be exercised.

What is claimed is:

1. An apparatus for controlling vibration of sheet steel comprising an apparatus for controlling vibration of a steel sheet being processed in a steel processing line, comprising:

an electromagnet for generating magnetic forces acting at right angles on the steel sheet;

a sensor for detecting separation distances between the steel sheet and said electromagnet;

a controller for controlling a flow of driving current through said electromagnet according to separation distances detected by said sensor, said controller including a control circuit whose gain is adjusted for controlling said driving current in accordance with information related to the steel sheet, including thickness data, running speeds, joint locations, sheet widths and line tension data at the time the controlling is performed wherein said controller further comprises a judging circuit for judging whether a steel sheet is present within a given range of a detected distance and which operates to turn off control of said electromagnet corresponding to said sensor not detecting presence of a steel sheet.

2. An apparatus for controlling vibration of sheet steel comprising an apparatus for controlling vibration of a steel sheet being processed in a steel processing line, comprising:

an electromagnet for generating magnetic forces acting at right angles on the steel sheet;

a sensor for detecting separation distances between the steel sheet and said electromagnet;

a controller for controlling a flow of driving current through said a electromagnet according to separation distances detected by said sensor, said controller including a control circuit whose gain is adjusted for controlling said driving current in accordance with information related to the steel sheet, including thickness data, running speeds, joint locations, sheet widths and line tension data at the time the controlling is performed wherein said controller further comprises a gain table based on information on a variety of steel sheets, including thickness data, running speeds, joint locations, sheet widths and line tension data, so that adjusting the gain of said control circuit for each type of steel sheet is determined according to said gain table.

3. An apparatus for controlling vibration of sheet steel comprising an apparatus for controlling vibration of a steel sheet being processed in a steel processing line, comprising:

an electromagnet for generating magnetic forces acting at right angles on the steel sheet;

a sensor for detecting separation distances between the steel sheet and said electromagnet;

a controller for controlling a flow of driving current through said electromagnet according to separation distances detected by said sensor, said controller including a control circuit whose gain is adjusted for controlling said driving current in accordance with information related to the steel sheet, including thickness data, running speeds, joint locations, sheet widths and line tension data at the time the controlling is performed wherein said electromagnet comprises a plurality of pairs of electromagnets, said plurality of pairs disposed with a first electromagnet of each said pair disposed on a front-side of the steel sheet and the second electromagnet of said pairs disposed on a back-side of the steel sheet and offset from the first magnet of the respective pair.

4. An apparatus for controlling vibration of a steel sheet being processed in a steel processing line, comprising:

an electromagnet for generating magnetic forces acting at right angles on the steel sheet;

a sensor for detecting separation distances between the steel sheet and said electromagnet;

a controller for controlling a flow of driving current through said electromagnet according to a specific command value and separation distances detected by said sensor, and a moving device for moving said electromagnet transversely relative to the steel sheet to retreat to a standby position or to return to a detection position; wherein said moving device moves said electromagnet away from the steel sheet to said standby position, according to sheet information including welded joint data, and further performs a return operation to return said electromagnet to said detection position, and said controller changes said position command value at the time of moving said moving device according to a distance to be moved, and further provides a return operation command.

5. An apparatus according to claim 4, wherein said controller includes an integration device which is inactivated during a retreat operation or a return operation, wherein said integration device includes an integrating circuit which outputs an integral value by integrating signals which correspond to the difference value from the value of the steel sheet position, and resets said integration device.

6. An apparatus for controlling vibration of a steel sheet being processed in a steel processing line, comprising:

an electromagnet means formed by opposing pairs of electromagnets respectively disposed in proximity of front and back surfaces of the steel sheet for generating magnetic forces acting at right angles to sheet surfaces;

opposing pairs of sensors on each side of the steel sheet for detecting respective separation distances between the steel sheet and each of said electromagnets of an opposing pair of electromagnets;

a controller for controlling a flow of driving current through said pair of electromagnets according to differences in detected separation distances generated by said opposing pair of sensors and specific position command values derived from said differences in separation distances; and a moving device for moving said electromagnets of said pairs transversely relative to said steel sheet so as to retreat to a standby position or to return to a detection position; wherein said moving device moves said pairs of electromagnets away from said steel sheet to said standby position, according to sheet information including joint location data.

7. An apparatus according to claim 6, wherein said controller performs a retreat operation or a return operation by generating a zero as a target value for said position command value.

8. An apparatus according to claim 6, wherein said controller operates said moving device to perform a retreat operation or a return operation by varying said position command value in accordance with a separation distance detected by said pair of sensors relative to a corresponding pair of electromagnets.

9. An apparatus according to claim 6, wherein said controller includes an integration device which is inactivated during a retreat operation or a return operation, wherein said integration device includes an integrating circuit which outputs the integral value by integrating signals which correspond to the difference value from the value of the steel sheet position, and resets said integration device.

* * * * *